United States Patent [19]

Conlin

[11] 4,072,080

[45] Feb. 7, 1978

[54] SHEET MUSIC PAGE TURNING DEVICE

[76] Inventor: Daniel Conlin, 810 Cornwall Ave., P.O. Box No. 5, Fort Frances, Ontario, Canada

[21] Appl. No.: 659,671

[22] Filed: Feb. 20, 1976

[51] Int. Cl.[2] ..... G10G 7/00
[52] U.S. Cl. ..... 84/486
[58] Field of Search ..... 84/486–515

[56] References Cited

U.S. PATENT DOCUMENTS

| | | | |
|---|---|---|---|
| 229,313 | 6/1880 | Heilprin | 84/498 |
| 1,264,480 | 4/1918 | Baumeister et al. | 84/495 |
| 1,460,265 | 6/1923 | Mills | 84/504 |

FOREIGN PATENT DOCUMENTS

| | | | |
|---|---|---|---|
| 310,298 | 1/1919 | Germany | 84/490 |

*Primary Examiner*—Lawrence R. Franklin

[57] ABSTRACT

A sheet music page turning device includes a base which supports a vertical shaft upon which a plurality of page holder elements are rotatably mounted in an annular guide member. A number of sleeves are mounted rotatably on the vertical shaft and are operatively connected to the page holder elements. A retaining pin prevents advance of the page holder elements along the guide member. A foot controller or alternatively, an electric motor is operatively connected to the retaining pin to permit manual or automatic release to thereby enable the page holder elements to advance and the pages to turn.

6 Claims, 5 Drawing Figures

SHEET MUSIC PAGE TURNING DEVICE

BACKGROUND OF THE INVENTION

The present invention relates to a sheet music page turning device and more particularly to such a device which can be foot operated or automatically controlled.

A variety of sheet music page turning devices have been known heretofore since it was already widely recognized that it is frequently inconvenient and sometimes extremely difficult for a musician to manipulate the musical instrument and turn the pages of the sheet music by hand. However, such prior devices have never become as popular as might be expected, and this is believed to be attributable to the complexity and cost of such devices.

SUMMARY OF THE INVENTION

It is, therefore, one object of the present invention to provide a sheet music turning device which is relatively simple in construction and which is adapted for foot control or for automatic operation.

Other objects and advantages of the invention will become readily apparent from the following description of the invention.

According to the present invention there is provided a sheet music page turning device comprising in combination:

a base support member;

a vertical shaft carried by the base;

an annular guide track mounted on the shaft and adapted to movably support a plurality of page holder elements;

a plurality of spring-biased sleeve members mounted rotatably in superposed relation on the shaft;

a plurality of page holder elements supported by the annular guide track for movement thereabout;

a plurality of radial connecting arms secured to consecutively arranged ones of the sleeves and to consecutively arranged ones of the page holder elements whereby rotation of the sleeves serially results in the serial movement of the page holder elements along the annular guide track; and means for selectively retaining the page holder elements and foot controller means for controlling the retaining means.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
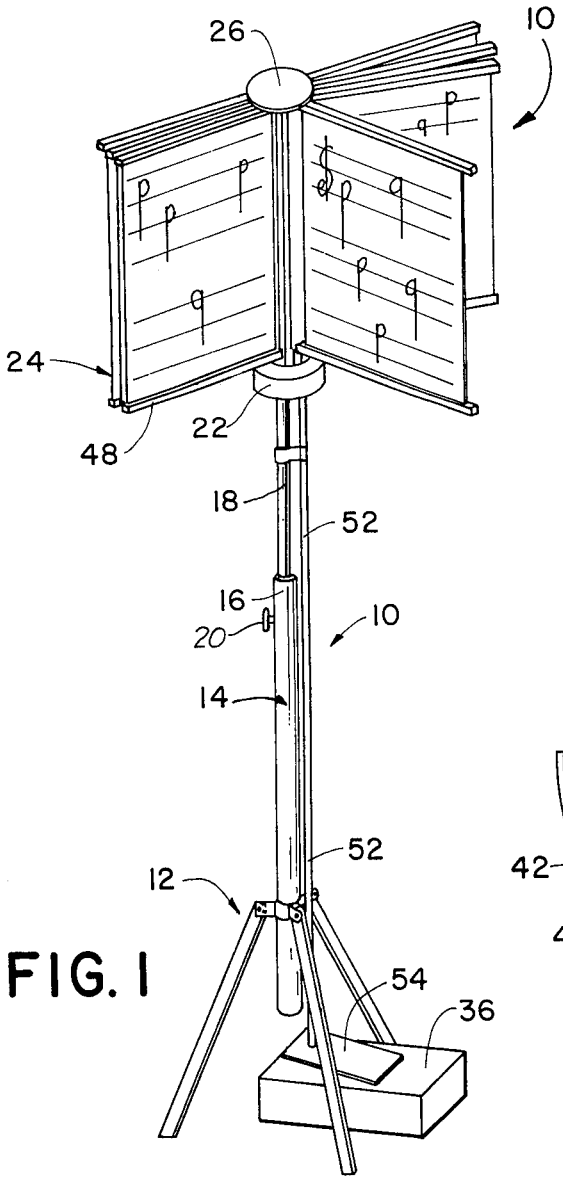
FIG. 1 is a perspective view of a sheet music page turning device embodying the features of the invention.
Figure 2:
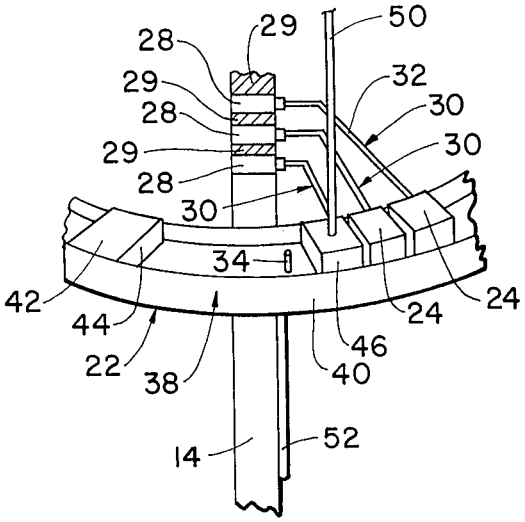
FIG. 2 is a partial perspective view of the guide track, sleeve members, radial connecting arms and pedestals of the page holder elements from he device shown in FIG. 1.
Figure 3:
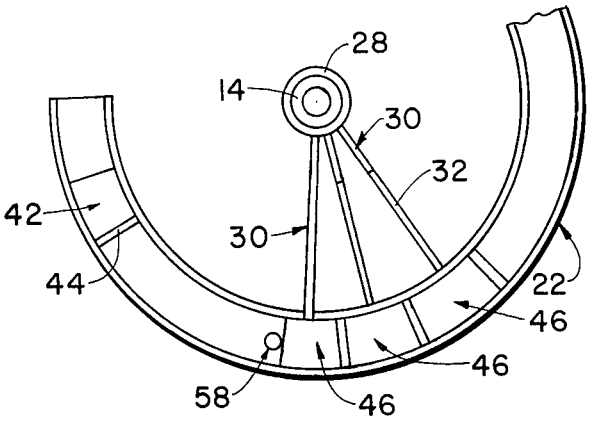
FIG. 3 is a top plan view of the annular guide track, the radial connecting arms and the operative connection between the shaft-mounted sleeve elements and the page holder elements.

Referring to the drawings there is shown generally, by reference numeral 10, a sheet music page turning device. A base support member 12, preferably in the form of a tripod arrangement as depicted, carries a vertical shaft 14 which may consist of two or more telescoping sections 16, 18 secured in place by a set screw 20. The upper portion of the shaft may be of reduced diameter and an annular guide track 22 is mounted fixedly on the shaft. The annular guide track, as will become clear, is adapted to support a plurality of page holder elements 24. The shaft 14 extends upwardly beyond the guide track 22 to carry a guide closure element 26 at its upper end.

Figure 4:
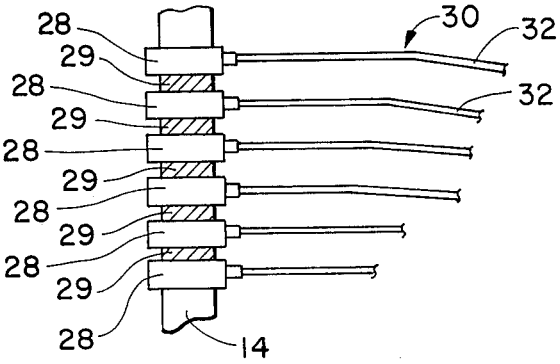
FIG. 4 is an enlarged view of the vertical shaft and the sleeve elements mounted thereon.

Intermediate the annular guide track and the guide closure element shaft 14 carries a plurality of sleeve members 28 which are mounted in superposed relation for a reason which will become clear. Each of such sleeve members is loosely mounted on the shaft and is biased in the same direction by means of a torsion spring 29. Each of the sleeve members is given a generally radially extending connecting arm 30. Each of such arms is connected at one end to one of the sleeve members and at the other end to one of a plurality of page holder elements which are arranged in side-by-side relationship on the annular guide track. It will be understood that the radial connecting arms are connected between consecutively disposed sleeve members and consecutively arranged page holder elements. Thus, by virtue of the torsion spring associated with each sleeve member the sleeve member transmits its biasing force through its radial connecting arm to the page holder element to which it is also connected so as to urge the page holder element to advance along the guide track. As depicted most clearly in FIG. 4, the radial connecting arms, except for the one secured to the lower-most of the sleeve members, are provided with an offset or inclined section 32 to allow for the connections with the page holder elements in a substantially horizontal plane.

The page holder elements are detained from being advanced along the guide track by means of a retainer pin element 34 which is normally urged into the path of movement of the page holder element by a control mechanism 36 to be described.

Turning to the annular guide track it will be observed that it desirably takes the form of a circumferentially extending inverted U-shaped channel member 38 and is mounted coaxially upon shaft 14. Within the flange elements 40 of the guide track at an appropriate location there is provided a stop element 42 intended to limit the advancement of the first in line page holder elements. The inner surface of the stop element is given a sound reducing lining 44 such that upon striking the stop element there will be no distracting sound.

Each of the page holder elements includes a pedestal element 46 which is shaped and dimensioned to fit slidably between flanges 40 of the guide track for advancement therein. A sheet music page receiving frame 48 is supported on a vertical stem 50 which extends upwardly from the pedestal element. The upper extremity of stem 50 is given a guide stud which is dimensioned to be slidably seated within an annular recess of the guide closure element 26 so that each of the page holder elements is supported slidably between the annular guide track and the guide closure element. If desired, spacer elements (not shown) may be interposed between the upper ends of the several stems in order to maintain the stems in a substantially vertical disposition as the page holder elements advance along the guide track. This is important, as will be appreciated, in order to present the pages of sheet music to the musician in substantially vertical planes. As will be understood, the pedestals of the page holder elements and the upper extremities of the stems may be so arranged within the guide track and guide closure element, respectively, that advancement is facilitated through the use of ball or roller bearings.

The page holder elements are, as described above, under the influence of an advancing force by virtue of torsion springs 29 which tend to rotate the sleeves about shaft 14 and the radial connecting arms which transmit the force of the torsion springs to the page holder elements. As stated above, a retainer pin element 34 is positioned to abut against the forward face of the pedestal of the leading page holder element to prevent its advancement. The retainer pin is carried at the end of a generally vertical extending slide rod 52 which is pivotably secured at its other end to the free end of a foot pedal 54. As shown in the drawings the slide rod may extend upwardly along the outer surface of shaft 14. However, it is within the contemplation of the invention to position the slide rod so that it extends upwardly within shaft 14 which is made hollow for this purpose as well as to reduce the cost and weight of the device. A spring 56 is mounted with relation to the foot pedal such that slide rod 52 is normally biased in an upwardly direction so as to cause the etainer pin 34 to project through an aperture 58 in the guide track into the path of movement of the page holder elements. Thus, when it is desired to release the foremost page holder element the foot pedal is depressed against the force of spring 56 to lower slide rod 52 and withdraw the retainer pin from its obstructing position in the path of advancement of the page holder elements. The first of the page holder elements will then be advanced by the force of torsion spring 29 until it engages stop element 42. As soon as the foremost page holder element begins to advance the pressure on the foot pedal is released so that the slide rod is immediately urged upwardly again and the retainer pin is forced in front of the next pedestal to arrest its forward movement along the guide track. Desirably the lower forward and rear faces of each of the pedestals are chamfered to facilitate interpositioning of the retainer pin in front of the next adjacent pedestal.

Figure 5:
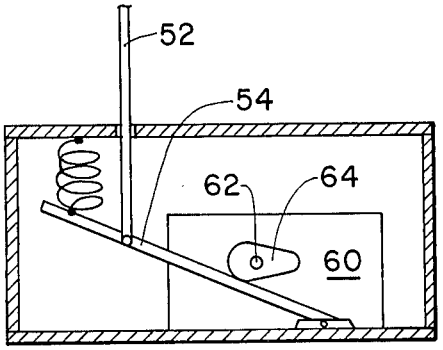
FIG. 5 is a fragmentary side elevational view, partly in cross-section, showing one embodiment of a motorized foot controller.

As illustrated in FIG. 5 the foot controller may take a different form, i.e., it may be operated in a completely automatic manner. Thus, a pedal element 54 may be pivotably mounted within the controller unit operatively connected to slide rod 52 as described above. According to this embodiment, however, a motor 60, which may either be mechanical or electrical, is provided and its shaft 62 may be furnished with a cam 64. Upon rotation of the motor and its shaft the cam 64 will cyclically engage with pedal 54 to withdraw the retainer pin 34 from its obstructing position as described above. A timer mechanism, not shown, may be connected to the motor and speed reducing means may also be employed in order to withdraw the retainer pin at a predetermined rate. Such timers and speed reducing means are well known and are readily available commercially. Therefore, it is not believed necessary to encumber the present specification with a description of such components.

From the foregoing it will be seen that a page turning device for sheet music has been provided which is of relatively simple construction, is compact and reliable as compared with the usual prior art device intended to accomplish the same primary objective.

I claim:

1. A sheet music page turning device comprising in combination:

a base support member;

a verticalshaft carried by said base;

an annular guide track comprising a single circumferentially extending inverted U-shaped channel member mounted coaxially upon said vertical shaft and adapted to support a plurality of page holder elements movably thereon;

a plurality of spring-biased sleeve members mounted rotatably in superposed relation on said shaft;

a plurality of page holder elements supported within said channel member for movement therewithin;

a plurality of radial connecting arms secured to consecutively arranged ones of said sleeves and to consecutively arranged ones of said page holder elements whereby rotation of said sleeves serially results in the serial movement of said page holder elements within said channel member;

a foot pedal pivotably mounted on a pedal support member, a generally vertically extending slide rod connected to the free end of said foot pedal and provided with a retainer pin at the upper end thereof dimensioned to project slidably within an aligned aperture in said channel member into the path of movement of said page holder elements;

and spring means for normally biasing said slide rod upwardly such that said retainer pin projects through the said aperture in said channel member to prevent advancement of the formost of said page holder elements.

2. A sheet music page turning device according to claim 1, wherein each of said sleeve members is individually biased by a torsion spring adapted to advance the associated page holder element along said annular guide track.

3. A sheet music page turning device according to claim 1, wherein each of said page holder elements includes a pedestal element dimensioned to be slidably retained within said annular guide track and a sheet music page receiving frame supported thereon.

4. A sheet music page turning device according to claim 3, wherein each of said page holder elements includes an upper guide stud and a guide closure element is mounted on said vertical shaft adapted to movably support said guide studs and thereby maintain said page receiving frames in a generally vertical disposition.

5. A sheet music page turning device according to claim 1, wherein motor means is provided and cam means is carried by the shaft of said motor, said cam means being cyclically engageable with said foot pedal for periodically releasing said page holder element retaining means to thereby permit advancement of said page holder elements and the turning of pages.

6. A sheet music page turning device according to claim 5, wherein said motor is an electric motor.

* * * * *